US006917337B2

(12) United States Patent
Iida et al.

(10) Patent No.: US 6,917,337 B2
(45) Date of Patent: Jul. 12, 2005

(54) ADAPTIVE ANTENNA UNIT FOR MOBILE TERMINAL

(75) Inventors: Atsuo Iida, Kawasaki (JP); Takeshi Toda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 27 days.

(21) Appl. No.: 10/454,749

(22) Filed: Jun. 4, 2003

(65) Prior Publication Data

US 2003/0232633 A1 Dec. 18, 2003

(30) Foreign Application Priority Data

Jun. 5, 2002 (JP) ..... 2002-164563

(51) Int. Cl.[7] ..... H01Q 1/24

(52) U.S. Cl. ..... 343/702; 343/757; 343/815; 455/575.7

(58) Field of Search ..... 343/702, 757, 343/758, 763, 765, 815; 455/575.7, 575.1, 562.1

(56) References Cited

U.S. PATENT DOCUMENTS

| | | | | |
|---|---|---|---|---|
| 5,534,872 A | * | 7/1996 | Kita | 342/146 |
| 6,167,346 A | * | 12/2000 | Fukawa | 701/208 |
| 6,369,770 B1 | | 4/2002 | Gothard et al. | |

FOREIGN PATENT DOCUMENTS

| | | |
|---|---|---|
| EP | 1 124 391 A1 | 8/2001 |
| JP | 11-284424 | 10/1999 |
| JP | 2002-16432 | 1/2002 |
| WO | WO 98/16077 | 4/1998 |
| WO | WO 98/29968 | 7/1998 |
| WO | WO 01/35490 A1 | 5/2001 |

OTHER PUBLICATIONS

European Search Report dated Aug. 31, 2004.
Dinger, "Reactively Steered Adaptive Array Using Microstrip Patch At 4 GHZ", IEEE Trans. Antennas & Propag., vol. AP–32 No. 8, pp. 848–856, Aug. 1984.
Dinger, et al., "A Compact HF Antenna Array Using Reactively–Terminated Parasitic Elements For Pattern Control" Naval Research Laboratory Memorandum Report 4797, May 1992 pp. 1–32.
Dinger, "A Planar Version of a 4.0 GHZ Reactively Steered Adaptive Array" IEEE Trans. Antennas & Propag., vol. AP–34, No. 3 pp. 427–431, Mar. 1986.
Harrington, "Reactively Controlled Directive Arrays" IEEE Trans. Antennas & Propag., vol. AP–26, No. 3, pp. 390–395, May 1978.

* cited by examiner

*Primary Examiner*—Shih-Chao Chen
(74) *Attorney, Agent, or Firm*—Katten Muchin Zavis Rosenman

(57) ABSTRACT

An adaptive antenna unit is adapted to a mobile terminal for making mobile communication and adaptively forms an antenna directivity in a direction of a base station which exchanges signals with the mobile terminal. The adaptive antenna unit is provided with an azimuth sensor to detect at least one of rotation, inclination and present position of the mobile terminal, a transmitter-receiver section to control the antenna directivity in a direction in which a reception characteristic improves based on reception signals received from a plurality of antenna elements forming the antenna directivity, and a mechanism for correcting the antenna directivity in the direction of the base station, based on the at least one of rotation, inclination and present position of the mobile terminal detected by the azimuth sensor.

17 Claims, 16 Drawing Sheets

ADAPTIVE ANTENNA UNIT FOR MOBILE TERMINAL

BACKGROUND OF THE INVENTION

This application claims the benefit of a Japanese Patent Application No. 2002-164563 filed Jun. 5, 2002, in the Japanese Patent Office, the disclosure of which is hereby incorporated by reference.

1. Field of the Invention

The present invention generally relates to adaptive antenna units, and more particularly to an adaptive antenna unit for a mobile terminal, which adaptively controls an antenna directivity in a direction of a base station which transmits and receives signals with the mobile terminal. The present invention also relates to a mobile terminal which uses such an adaptive antenna unit.

2. Description of the Related Art

Recently, mobile (or wireless) communications are becoming increasingly popular. As a result, transmission techniques, including transmission techniques which use microwave bands, transmission techniques having a large transmission capacity, and transmission techniques capable of suppressing interference, have become very important.

On of such important transmission techniques in the mobile communication is a technique which uses an adaptive antenna unit. The adaptive antenna unit is particularly suited for use in a mobile terminal (or mobile station) for making the mobile communication which requires a large transmission capacity, a high-sensitivity signal reception, reduced size and weight of the terminal, and low power consumption.

FIG. 1 is a functional block diagram for explaining an example of a conventional adaptive antenna unit. The adaptive antenna unit shown in FIG. 1 includes antenna elements $\mathbf{1}_1$ through $\mathbf{1}_n$, variable phase circuits $\mathbf{2}_1$ through $\mathbf{2}_n$ provided in correspondence with the antenna elements $\mathbf{1}_1$ through $\mathbf{1}_n$, a phase control circuit 3, a combining circuit (Σ) 4, and a reception circuit 5. Reception signals from the antenna elements $\mathbf{1}_1$ through $\mathbf{1}_n$ are given phase changes in the corresponding variable phase circuits $\mathbf{2}_1$ through $\mathbf{2}_n$, combined in the combining circuit 4, and demodulated in the reception circuit 5.

The phase control circuit 3 determines amounts of phase changes to be given at the variable phase circuits $\mathbf{2}_1$ through $\mathbf{2}_n$, using output signals of the variable phase circuits $\mathbf{2}_1$ through $\mathbf{2}_n$ and an output signal of the combining circuit 4, so that a signal-to-interference-plus-noise ratio (SINR) of the output signal of the combining circuit 4 becomes a maximum. For example, the phase control circuit 3 determines the amounts of phases changes to be given at the variable phase circuits $\mathbf{2}_1$ through $\mathbf{2}_n$ based on an algorithm using minimum mean square error (MMSE). Hence, the phase control circuit 3 controls the amounts of phase changes of the variable phase circuits $\mathbf{2}_1$ through $\mathbf{2}_n$, and forms a directivity.

FIGS. 2 and 3 are diagrams for explaining a directivity formed by an adaptive antenna unit of a base station. As shown in FIG. 2, when a first base station 14-1 is exchanging signals with first and second mobile terminals 14-2 and 14-3, signals transmitted from second and third base stations 14-4 and 14-5, other than the first base station 14-1, become noise with respect to the first base station 14-1.

In this case, as shown in FIG. 3, an adaptive antenna unit of the first base station 14-1 forms a directivity having a large gain with respect to directions of the first and second mobile terminals 14-2 and 14-3, and forms a directivity having a zero gain with respect to directions of the second and third base stations 14-4 and 14-5 which become noise sources.

FIGS. 4 and 5 are diagrams for explaining a directivity formed by an adaptive antenna unit of a mobile terminal. As shown in FIG. 4, when a first mobile terminal 15-1 is exchanging signals with a base station 15-2, signals other than the signal received directly from the base station 15-2, become noise with respect to the first mobile terminal 15-1. The signals which become noise with respect to the first mobile terminal 15-1 include interference input through reflections by buildings and the like, noise input through reflections by remote mountains and the like, and signals transmitted from a second mobile terminal 15-3 other than the first mobile terminal 15-1.

In this case, as shown in FIG. 5, the adaptive antenna unit of the first mobile terminal 15-1 forms a directivity having a large gain with respect to a direction of the base station 15-2 with which the first mobile terminal 15-1 exchanges signals, and forms a directivity having an extremely small gain or a zero gain with respect to a direction of a noise source such as the second mobile terminal 15-3 other than the first mobile terminal 15-1, the interference and the reflections.

Therefore, by forming the directivity which has a large gain with respect to the signal exchanging direction and a having substantially zero gain with respect to directions other than the signal exchanging direction, such as directions of communication equipments which become noise sources, it is possible to suppress the noise and the interference. In addition, it is possible to reduce the transmission power and reduce the power consumption, because the signals are transmitted in only the necessary direction and no signals are transmitted in the unnecessary directions.

For example, a mobile terminal which has the directivity by use of an array antenna is proposed in a Japanese Laid-Open Patent Application No. 11-284424. According to this proposed mobile terminal, the directivity is formed so as not to form a beam with a large gain in a direction towards a human head which has a large attenuation.

The situation of the mobile terminal is different from that of the base station. As shown in FIGS. 4 and 5, the signal exchanging direction required for the communication is only in one direction towards the base station 15-2 which relays the communication. Hence, the directivity of the mobile terminal 15-1 should suppress the noise sources including the transmitting signals from the other mobile terminals 15-3 and the base stations other than the base station 15-2, and the interference and reflections from the mountains and buildings.

Due to the recent progress made in semiconductor technologies related to mobile communications, it is no longer impossible to realize a mobile communication system which uses a microwave to millimeter wave band radio frequencies (RF), carries out a high-quality transmission comparable to those of fixed communication networks, and carries out a high-speed transmission on the order of several hundred MHz or greater. However, in the mobile communication system (or cellular communication system), problems such as increased radio wave propagation loss and difficulty in increasing the cell diameter as the frequency becomes higher, and difficulty in suppressing the effects of spreading delays caused by reflection, scattering and diffraction due to buildings, mountains and the like, become more notable. In addition, because a high-speed transmission is required and it is necessary to increase the power per bit of the high-speed data, there is a problem in that the transmission power becomes considerably large. Therefore, the following objects (A1)–(A3) need to be achieved.

(A1) Reduced inter-cell interference;

(A2) Suppression of delay waves (long delay waves) of long delay times; and (A3) Reduction of required transmission power.

The adaptive antenna technology is a promising technology for achieving the above described objects (A1)–(A3). In other words, the adaptive antenna technology can achieve the following effects (B1)–(B3).

(B1) Elimination of interference from other cells;

(B2) Suppression of long delay waves (interference); and (B3) Reduction of transmission power by an antenna gain amounting to the number of antenna elements.

Particularly in the case of a down-line from the base station to the mobile terminal, a larger transmission capacity is required than an up-line from the mobile terminal to the base station. For this reason, it is desirable to employ the adaptive antenna technology not only in the base station but also in the mobile terminal. However, when applying the adaptive antenna technology to the mobile terminal, the conditions for the mobile terminal is much more severe than those for the base station in order to realize reduced size and weight, reduced power consumption and reduced cost of the mobile terminal.

SUMMARY OF THE INVENTION

Accordingly, it is a general object of the present invention to provide a novel and useful adaptive antenna unit and a mobile terminal, in which the problems described above are eliminated.

Another and more specific object of the present invention is to provide an adaptive antenna unit which controls an antenna directivity of the mobile terminal depending on a motion in an orientation or inclination of the mobile terminal so as to maintain a large gain in a direction of a base station, and to simultaneously realize reduced size, reduced weight, reduced power consumption and reduced cost, and to provide a mobile terminal which uses such an adaptive antenna unit.

Still another object of the present invention is to provide an adaptive antenna unit which is adapted to a mobile terminal for making mobile communication and adaptively forms an antenna directivity in a direction of a base station which exchanges signals with the mobile terminal, comprising an azimuth sensor to detect at least one of rotation, inclination and present position of the mobile terminal; a transmitter-receiver section to control the antenna directivity in a direction in which a reception characteristic improves based on reception signals received from a plurality of antenna elements forming the antenna directivity; and means for correcting the antenna directivity in the direction of the base station, based on the at least one of rotation, inclination and present position of the mobile terminal detected by the azimuth sensor. According to the adaptive antenna unit of the present invention, it is possible to maintain a large gain in a direction of the base station, and to simultaneously realize reduced size, reduced weight, reduced power consumption and reduced cost.

A further object of the present invention is to provide a mobile terminal for making mobile communication with a base station by exchanging signals, comprising a plurality of antenna elements to adaptively form an antenna directivity in a direction of the base station; an azimuth sensor to detect at least one of rotation, inclination and present position of the mobile terminal; a transmitter-receiver section to control the antenna directivity in a direction in which a reception characteristic improves based on reception signals received from the plurality of antenna elements; and means for correcting the antenna directivity in the direction of the base station, based on the at least one of rotation, inclination and present position of the mobile terminal detected by the azimuth sensor. According to the mobile terminal of the present invention, it is possible to maintain a large gain in a direction of the base station, and to simultaneously realize reduced size, reduced weight, reduced power consumption and reduced cost.

Other objects and further features of the present invention will be apparent from the following detailed description when read in conjunction with the accompanying drawings.

DESCRIPTION OF THE PREFERRED EMBODIMENTS

Figure 6:
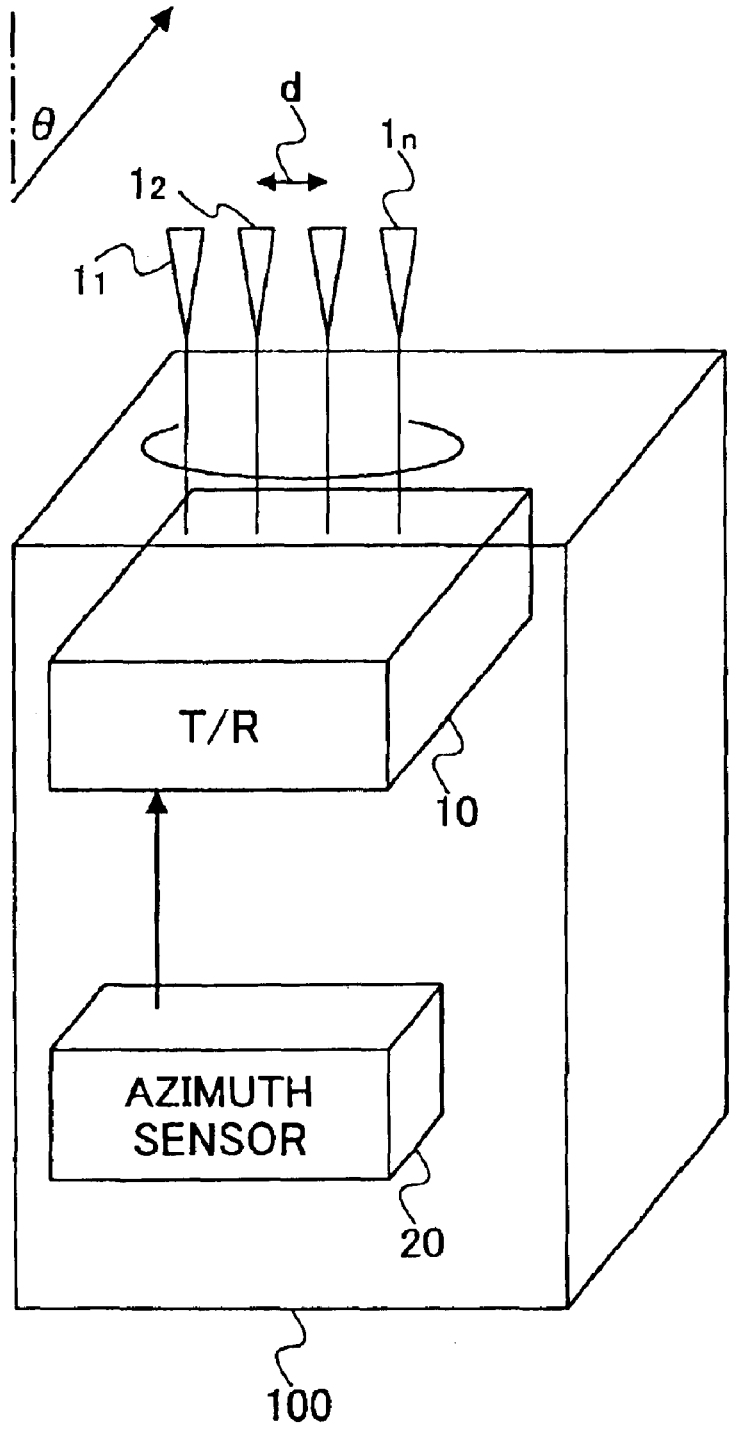
FIG. 6 is a diagram showing a basic structure of a first embodiment of an adaptive antenna unit according to the present invention.

FIG. 6 is a diagram showing a basic structure of a first embodiment of an adaptive antenna unit according to the present invention. The adaptive antenna unit is applied to a mobile terminal (or mobile station) 100 and includes an array antenna which is made up of a plurality of antenna elements $\mathbf{1}_1$ through $\mathbf{1}_n$, a transmitter-receiver section 10 which has a function of controlling a directivity of the array antenna, and an azimuth sensor 20 which detects an azimuth or inclination of the mobile terminal. In this embodiment, the antenna elements $\mathbf{1}_1$ through $\mathbf{1}_n$ are arranged linearly on the same plane.

Figure 1:
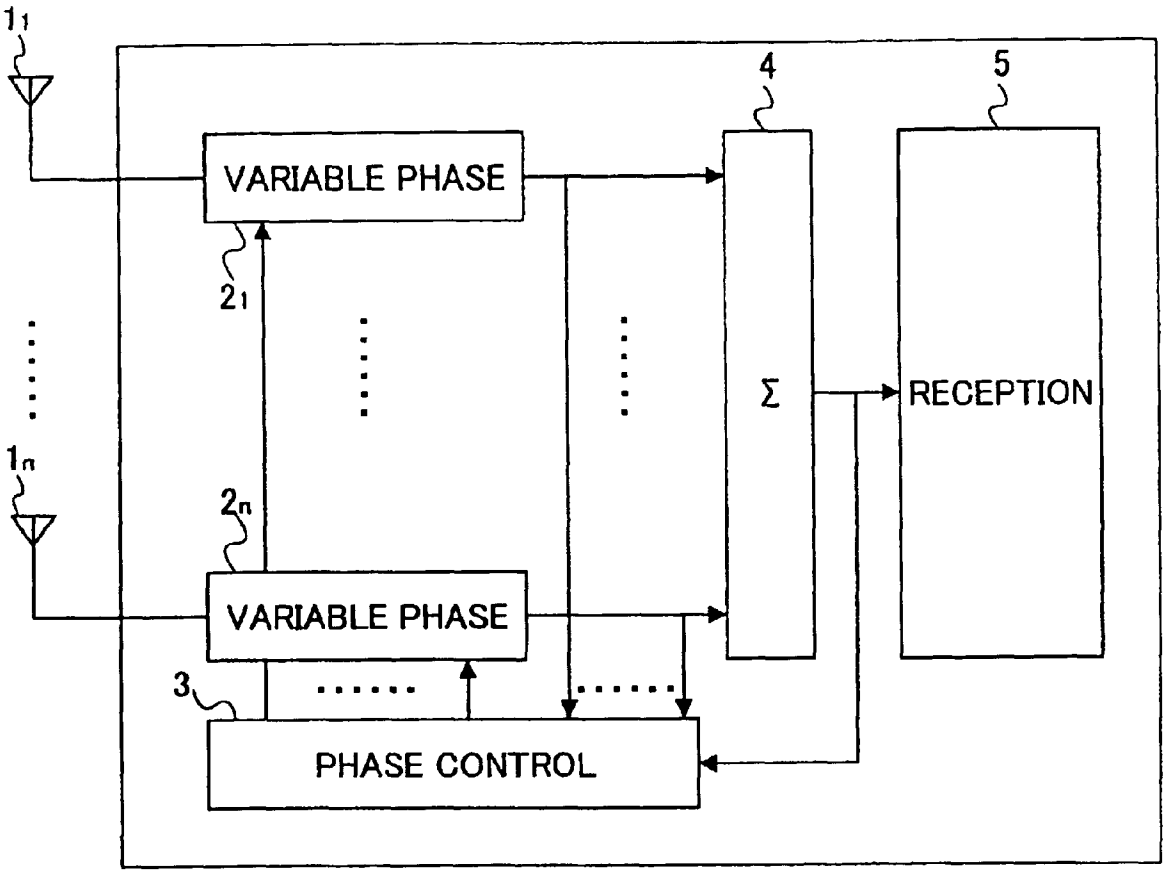
FIG.1 PRIOR ART
FIG. 1 is a functional block diagram for explaining an example of a conventional adaptive antenna unit.
Figure 2:
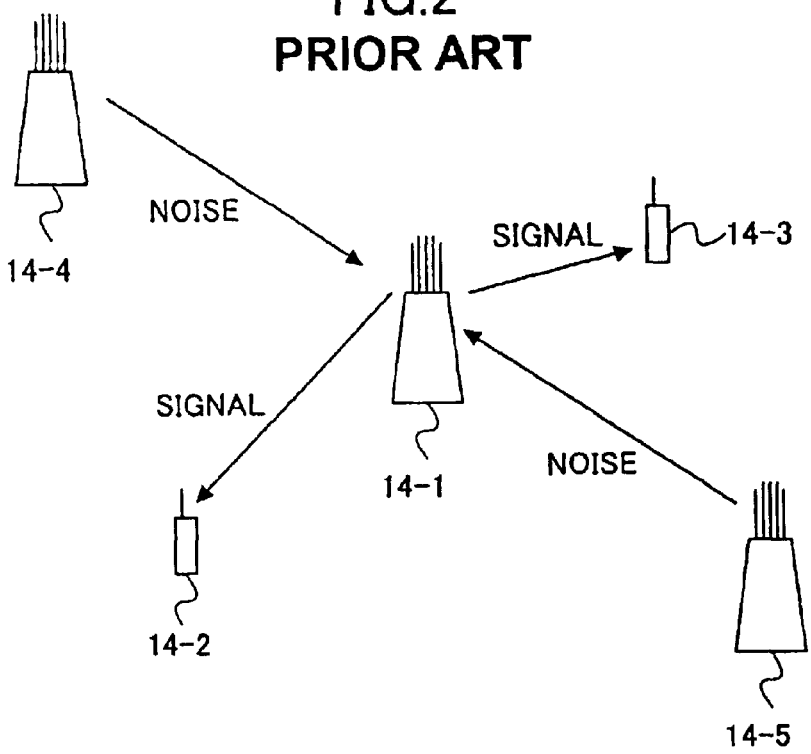
FIG.2 PRIOR ART
FIG. 2 is a diagram for explaining a directivity formed by an adaptive antenna unit of a base station.
Figure 3:
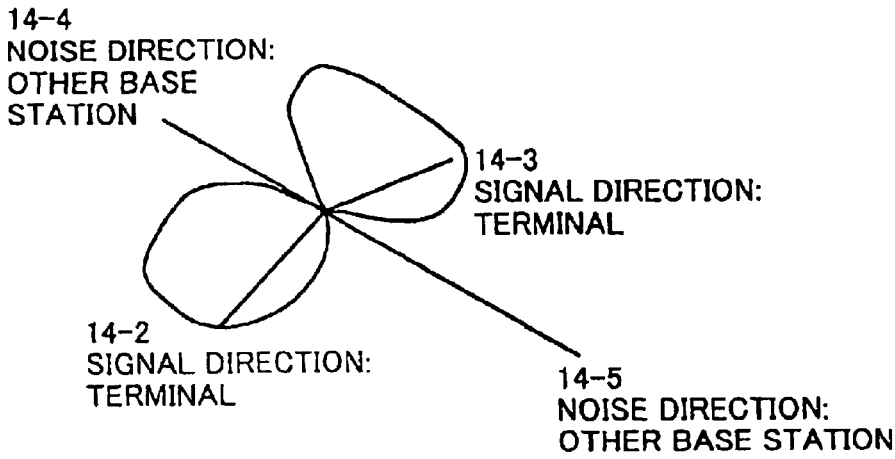
FIG.3 PRIOR ART
FIG. 3 is a diagram for explaining the directivity formed by the adaptive antenna unit of the base station.
Figure 4:
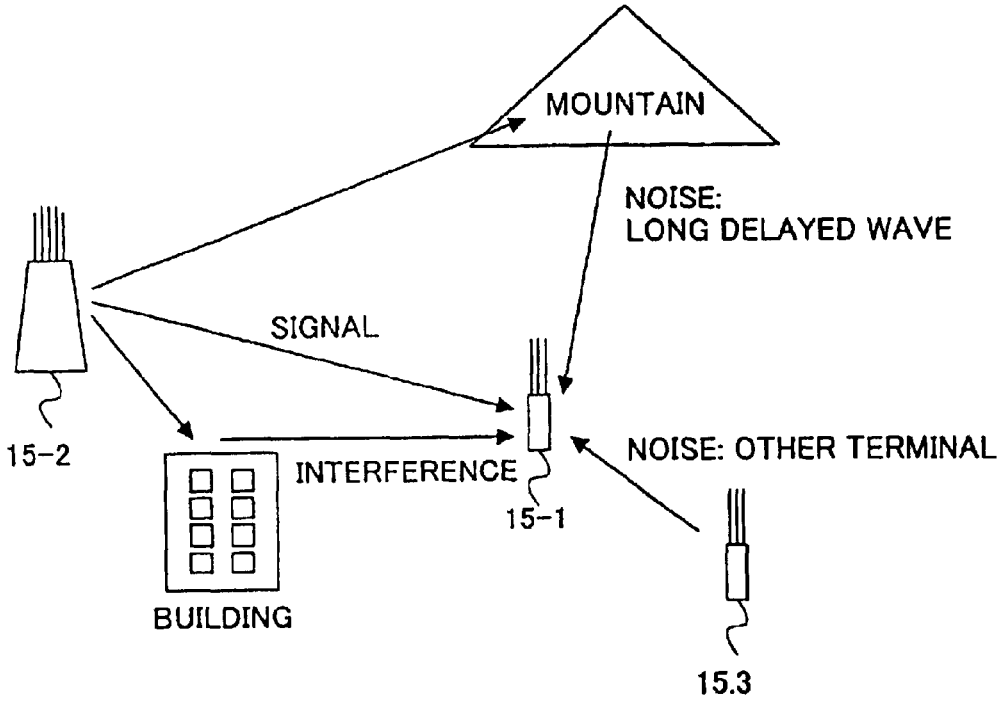
FIG.4 PRIOR ART
FIG. 4 is a diagram for explaining a directivity formed by an adaptive antenna unit of a mobile terminal.
Figure 5:
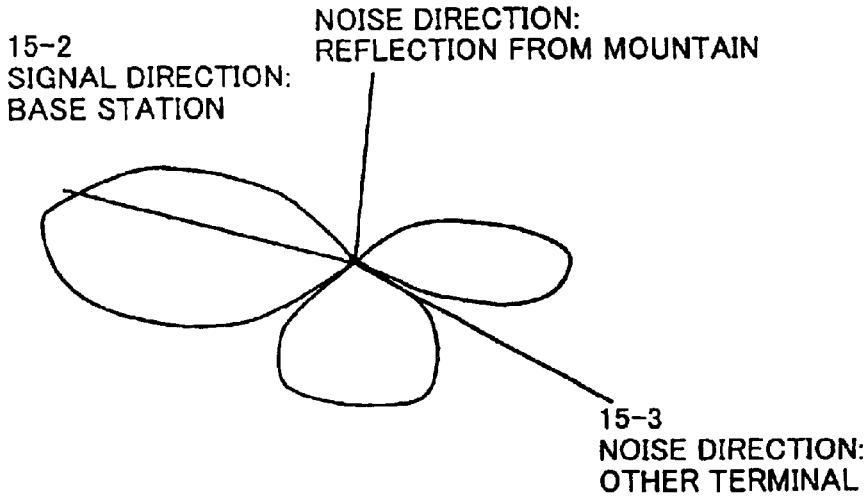
FIG.5 PRIOR ART
FIG. 5 is a diagram for explaining the directivity formed by the adaptive antenna unit of the mobile terminal.
Figure 7:
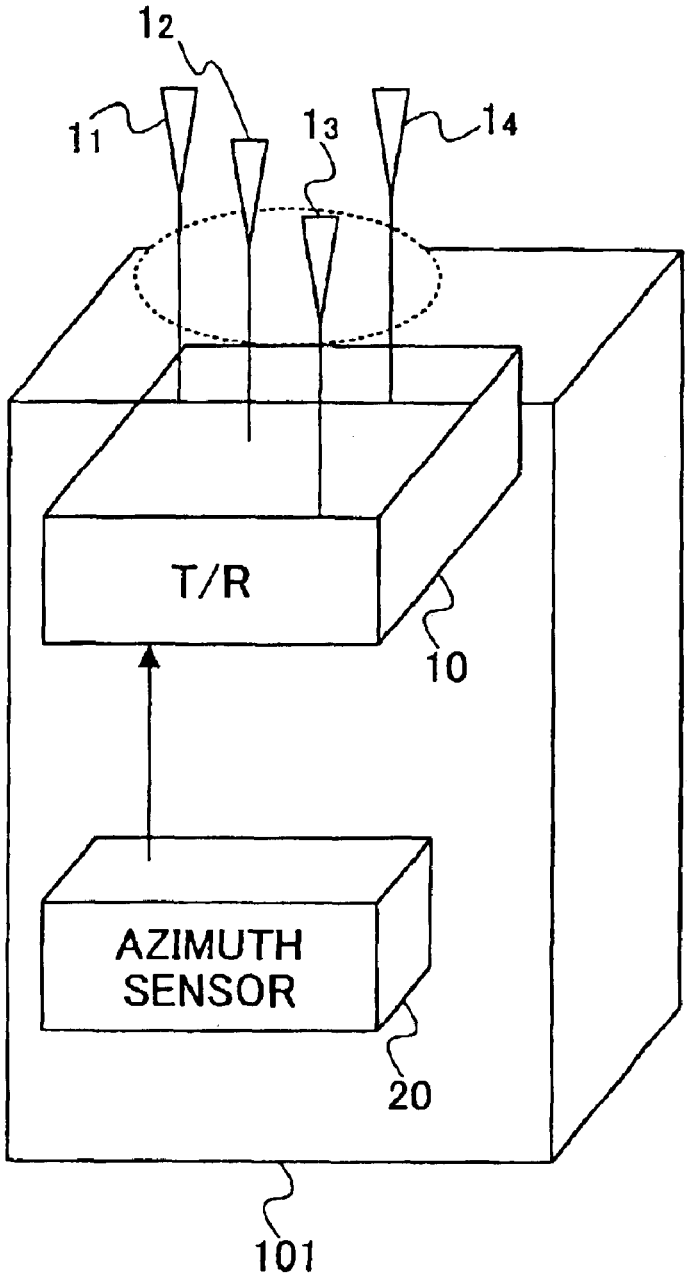
FIG. 7 is a diagram showing a basic structure of a second embodiment of the adaptive antenna unit according to the present invention.

FIG. 7 is a diagram showing a basic structure of a second embodiment of the adaptive antenna unit according to the present invention. In FIG. 7, those parts which are the same as those corresponding parts in FIG. 6 are designated by the same reference numerals, and a description thereof will be omitted. In this embodiment, the antenna elements $\mathbf{1}_1$ through $\mathbf{1}_n$ of a mobile terminal 101 are arranged in an arc, so that a beam is more easily formed within the plane in which the antenna elements $\mathbf{1}_1$ through $\mathbf{1}_n$ are arranged when compared to the arrangement shown in FIG. 1.

Of course, the number of antenna elements is not limited to four in each of the first and second embodiments shown in FIGS. 6 and 7, and the number of antenna elements may be set to an arbitrary number greater than or equal to two.

By giving a phase weighting with respect to each of the antenna elements $\mathbf{1}_1$ through $\mathbf{1}_n$ which is different for the transmission and the reception, it is possible to arbitrarily control the directivity of the antenna elements $\mathbf{1}_1$ through $\mathbf{1}_n$ within the plane in which the antenna elements $\mathbf{1}_1$ through $\mathbf{1}_n$ are arranged. As one example of the directivity control, a phase delay of $[(k-1)d\times\sin\theta/c]$ may be applied with respect to a kth antenna element from the left in FIG. 1 for the transmission or reception, it is possible to form a directivity having a maximum sensitivity in a direction of an angle $\theta$ from the front, where $1\leqq k\leqq n$, d denotes a pitch of the antenna elements $\mathbf{1}_1$ through $\mathbf{1}_n$, and c denotes the speed of light.

The pitch d of the antenna elements $\mathbf{1}_1$ through $\mathbf{1}_n$ should be large in order to improve the sensitivity in the beam forming direction. However, when the pitch d is too large, the beam is formed in an unwanted direction called a grating lobe to deteriorate the sensitivity. In general, in order to reduce the effects of the grating lobe, it is desirable to set the pitch d of the antenna elements $\mathbf{1}_1$ through $\mathbf{1}_n$ to a value less than or equal to a wavelength $\lambda$, within a range in which the antenna elements $\mathbf{1}_1$ through $\mathbf{1}_n$ can be mounted.

A compact azimuth sensor, such as a gyro sensor, an electrostatic capacitance type acceleration sensor, a terrestrial magnetic sensor, and a global positioning system (GPS) which uses satellites, may be used to detect the azimuth or inclination of the mobile terminal 100. A plurality of kinds of such sensors may be used in combination and output information of the plurality of kinds of sensors may be integrated, so as to detect the azimuth or inclination of the mobile terminal 100 with a high accuracy.

For example, a sensor which detects a rotary angle or a rotary angular acceleration by a detecting the Corioris effect of a vibrating body by a piezoelectric element, may be used as the gyro sensor. Since one gyro sensor detects a rotation in one axial direction, three gyro sensors are used when detecting the rotary angular velocity three-dimensionally.

The physical quantity detectable by the gyro sensor is the angular velocity or the angular acceleration. Hence in order to convert the physical quantity detected by the gyro sensor into the rotary azimuth angle or the azimuth, an output signal of the gyro sensor is integrated once or twice. Furthermore, when obtaining an absolute azimuth angle or inclination angle, a periodical calibration is made to collate the output information of the gyro sensor with output information of another sensor, so as to correct an error and obtain an accurate absolute azimuth angle or inclination angle.

The electrostatic type acceleration sensor detects the acceleration applied thereto due to a change in the electrostatic capacitance of a dielectric caused by motion of the mobile terminal 100. The electrostatic type acceleration sensor can also detect a gravitational direction because it is capable of detecting an amount of constant change. Accordingly, the electrostatic type acceleration sensor does not require a calibration using another sensor as in the case of the gyro sensor.

The terrestrial magnetic sensor and the GPS are often used in automobile navigation apparatuses. Recently, the size of the terrestrial magnetic sensor and the GPS has become small, enabling the terrestrial magnetic sensor or the GPS to be mounted in a portable telephone set or the like. The terrestrial magnetic sensor detects an absolute azimuth from the terrestrial magnetic field. The GPS receives signals from a plurality of satellites and detects an absolute position from the latitude and longitude. Output information of the terrestrial magnetic sensor or GPS and map information including location information of the base stations are used to detect the position and azimuth of the base station which is closest to the present position.

Figure 8:
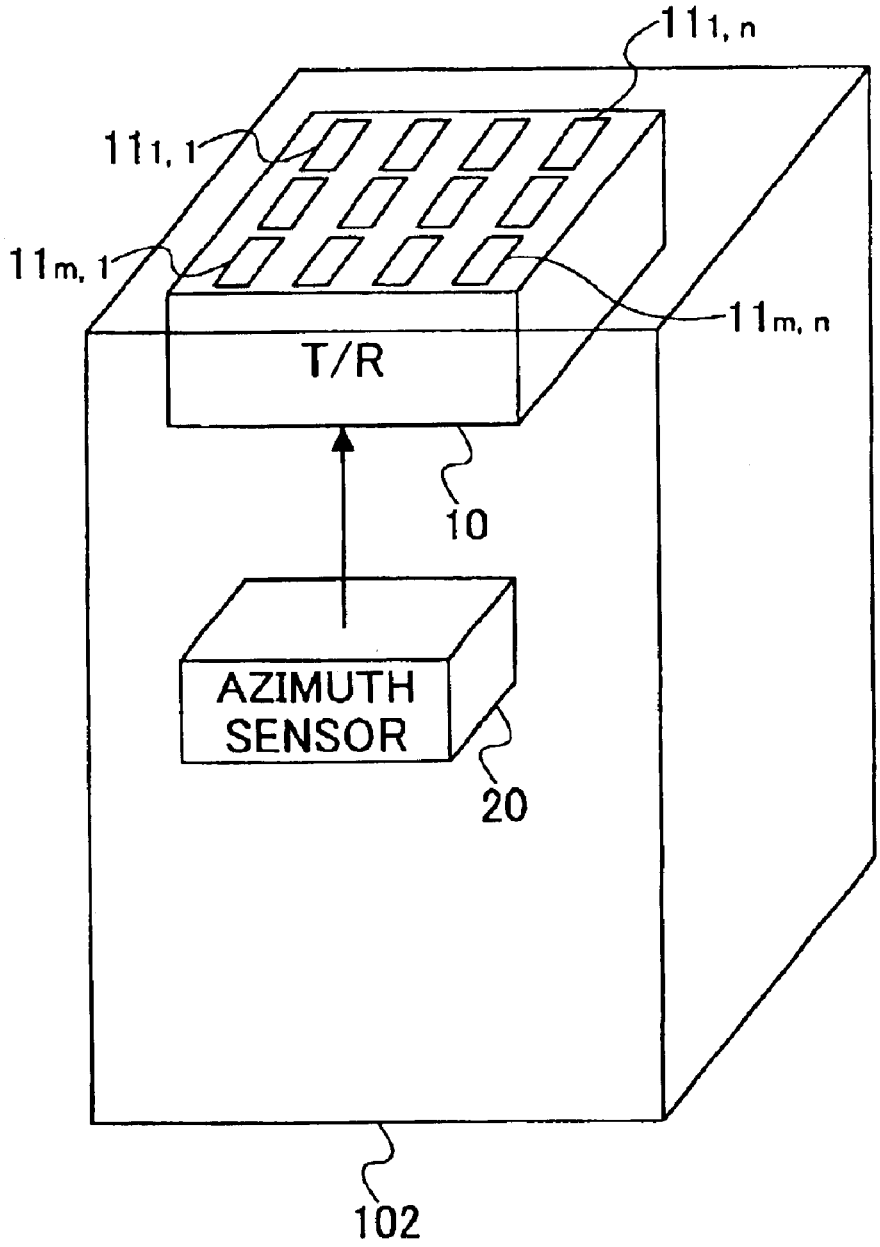
FIG. 8 is a diagram showing a basic structure of a third embodiment of the adaptive antenna unit according to the present invention.

FIG. 8 is a diagram showing a basic structure of a third embodiment of the adaptive antenna unit according to the present invention. The adaptive antenna unit is applied to a mobile terminal 102 and includes an array antenna which is made up of m×n planar antenna elements $\mathbf{11}_{1,1}$ through $\mathbf{11}_{m,n}$, a transmitter-receiver section 10 which has a function of controlling a directivity of the array antenna, and an azimuth sensor 20 which detects an azimuth or inclination of the mobile terminal. In this embodiment, the planar antenna elements $\mathbf{11}_{1,1}$ through $\mathbf{11}_{m,n}$ are arranged in a matrix arrangement on the same plane.

Figure 9:
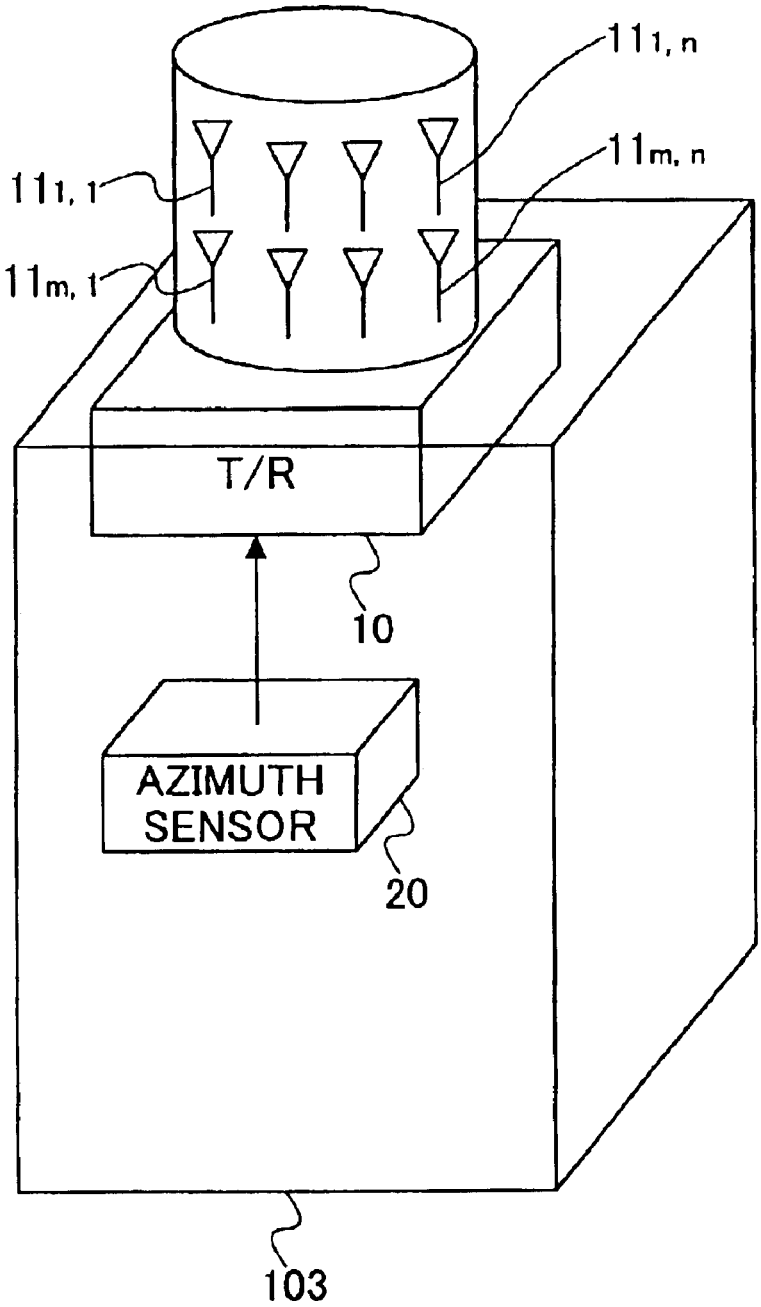
FIG. 9 is a diagram showing a basic structure of a fourth embodiment of the adaptive antenna unit according to the present invention.

FIG. 9 is a diagram showing a basic structure of a fourth embodiment of the adaptive antenna unit according to the present invention. The adaptive antenna unit is applied to a mobile terminal 103 and includes an array antenna which is made up of a plurality of dipole or unipole antenna elements $\mathbf{11}_{1,1}$ through $\mathbf{11}_{m,n}$, a transmitter-receiver section 10 which has a function of controlling a directivity of the array antenna, and an azimuth sensor 20 which detects an azimuth or inclination of the mobile terminal. In this embodiment, the dipole or unipole antenna elements $\mathbf{11}_{1,1}$ through $\mathbf{11}_{m,n}$ are provided on a cylindrical flexible film or the like and are arranged in an arcuate shape. A plurality of antenna elements $\mathbf{11}_{1,1}$ through $\mathbf{11}_{1,n}$, . . . , and $\mathbf{11}_{m,n}$ through $\mathbf{11}_{m,n}$ are arranged in a plurality of stages in a vertical direction as shown in FIG. 9.

Figure 10:
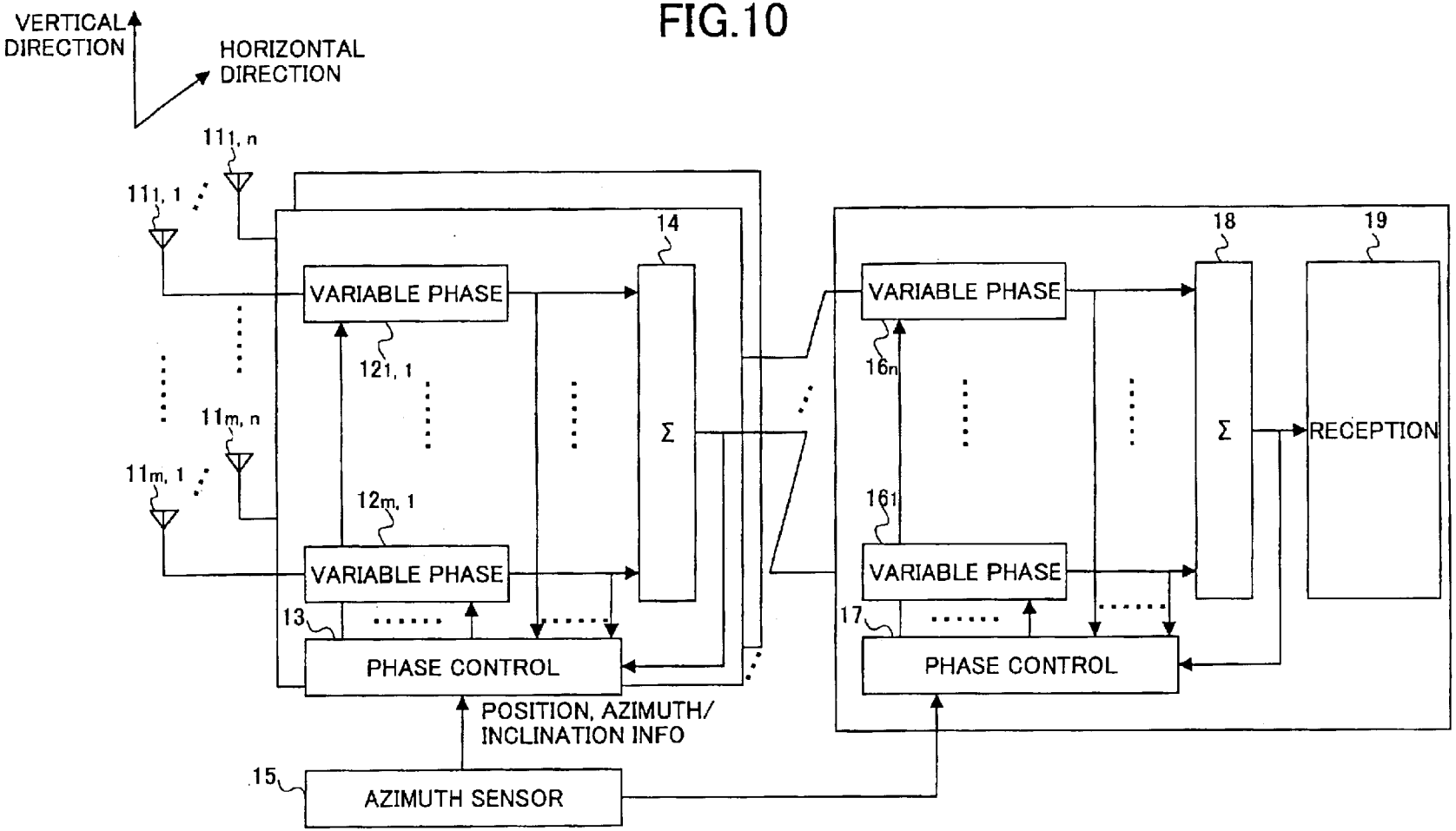
FIG. 10 is a system block diagram showing a transmitter-receiver section of the third embodiment of the adaptive antenna unit.

FIG. 10 is a system block diagram showing a transmitter-receiver section of the third embodiment of the adaptive antenna unit shown in FIG. 8. The transmitter-receiver section controls the directivity of the array antenna having the matrix arrangement.

For the sake of convenience, FIG. 10 shows variable phase circuits $\mathbf{12}_{1,1}$ through $\mathbf{12}_{m,1}$ which are provided with respect to the antenna elements $11_{1,1}$ through $11_{m,1}$ in the first row of the matrix arrangement of the antenna elements $11_{1,1}$ through $11_{m,n}$, where m indicates an antenna element position in the vertical direction and n indicates an antenna element position in the horizontal direction. A phase control circuit is provided with respect to the variable phase circuits $12_{1,1}$ through $12_{m,1}$. A combining circuit (Σ) 14 combines output signals of the variable phase circuits $12_{1,1}$ through $12_{m,1}$. A azimuth sensor 15 is made of a gyro sensor or GPS, and outputs to the phase control circuit 13 azimuth information indicating the azimuth angle or inclination angle of the mobile terminal 102.

Reception signals received by the antenna elements $11_{1,1}$ through $11_{m,1}$ are given phase changes in the corresponding variable phase circuits $12_{1,1}$ through $12_{m,1}$ and combined in the combining circuit 14. The phase control circuit 13 determines and controls the amount of phase change of each of the variable phase circuits $12_{1,1}$ through $12_{m,1}$ based on an algorithm using minimum mean square error (MMSE), using the output signals of the variable phase circuits $12_{1,1}$ through $12_{m,1}$ and the output signal of the combining circuit 14, so that a signal-to-interference-plus-noise ratio (SINR) of the output signal of the combining circuit 14 becomes a maximum.

With respect to the other antenna elements $11_{1,2}$ through $11_{m,2}$, . . . , and $11_{1,n}$ through $11_{m,n}$ in the vertical direction, variable phase circuits $12_{1,2}$ through $12_{m,2}$, . . . , and $12_{1,n}$ through $12_{m,n}$ (not shown), n−1 phase control circuits (not shown) and n−1 combining circuits (not shown) are provided similarly as described above, so as to control the directivity in the vertical direction. In other words, n vertical direction directivity forming circuits are provided in total with respect to the antenna elements $11_{1,1}$ through $11_{m,n}$.

Output signals of the n vertical direction directivity forming circuits, that is, output signals of n phase control circuits 14, are input to corresponding n variable phase circuits $16_1$ through $16_n$ for forming the horizontal direction directivity. The variable phase circuits $16_1$ through $16_n$ give to the input signals thereof the phase changes in the horizontal direction, and output signals of the variable phase circuits $16_1$ through $16_n$ are combined by a combining circuit (Σ) 18.

A phase control circuit 17 determines and controls the amount of phase change of each of the variable phase circuits $16_1$ through $16_n$ based on an algorithm using minimum mean square error (MMSE), using the output signals of the variable phase circuits $16_1$ through $16_n$ and the output signal of the combining circuit 18, so that a signal-to-interference-plus-noise ratio (SINR) of the output signal of the combining circuit 18 becomes a maximum.

The azimuth information output from the azimuth sensor 15 is utilized in the following manner. The directivities which are given by the amounts of phase changes determined by the phase control circuits 13 and 17 based on the MMSE algorithm may converge with a considerably large delay or, may not converge to optimum values, depending on the direction of an initial value of the azimuth information. Hence, the GPS is provided within the azimuth sensor 15, for example, and the initial value is set in the direction of the closest base station based on the present position information obtained from the GPS and the map information, so as to speed up the convergence in the direction of the directivity. The map information may be prestored within each mobile terminal 102 or, input via a communication with the base station.

In a normal state of use where a user of the mobile terminal 102 is standing still or walking, the direction of the base station does not frequently change. For this reason, one the amount of phase change of each of the variable phase circuits $12_{1,1}$ through $12_{m,n}$ and $16_1$ through $16_n$ is set, a change in the azimuth or inclination of the mobile terminal 102 is tracked by the azimuth sensor 15 and the directivity forming direction is corrected depending on a change in the azimuth or inclination.

In this case, a gyro sensor may be used as the azimuth sensor 15, so as to track the rotary angle of the mobile terminal 102 and to control the directivity of the array antenna depending on the rotary angle. The gyro sensor can detect a change in the rotary angle with a high accuracy, and can detect a quick rotary motion with a high accuracy. Hence, in the normal state of use of the mobile terminal 102, the antenna directivity can be effectively controlled based on the azimuth information detected by the gyro sensor. Of course, when controlling the directivity in three-dimensional directions, additional gyro sensors are used to detect the rotary motions in the horizontal and vertical directions.

Figure 11:
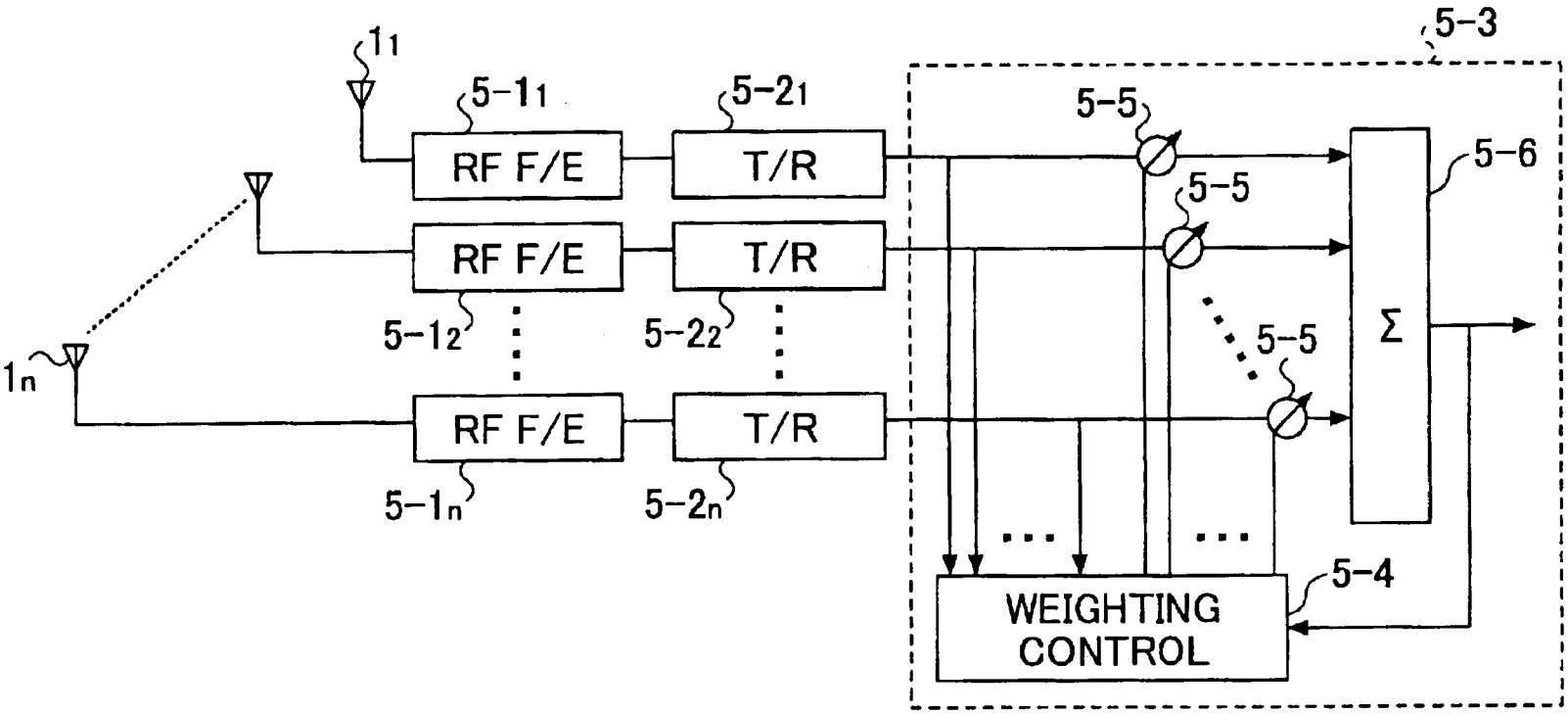
FIG. 11 is a system block diagram showing a baseband digital signal processing circuit.

FIG. 11 is a system block diagram showing a baseband digital signal processing circuit. Generally, a weighting circuit which gives the phase change in each variable phase circuit is realized by the baseband digital signal processing circuit. The arrangement shown in FIG. 11 includes a plurality of antenna elements $1_1$ through $1_n$, a plurality of transmitter-receiver radio frequency (RF) front ends (RFF/Es) 5-1$_1$ through 5-1$_n$, a plurality of transmitter-receivers (T/Rs) 5-2$_1$ through 5-2$_n$, and a digital signal processing circuit 5-3. The digital signal processing circuit 5-3 includes a weighting control circuit 5-4, a plurality of weighting circuits 5-5, and a combining (Σ) circuit 5-6, and carries out a weighting with respect to baseband digital signal which is output for each antenna element $1_i$ via the corresponding transmitter-receiver 5-2$_i$, where i is an integer satisfying i=1, . . . , n.

One RFF/E 5-1$_i$ and one transmitter-receiver 5-2$_i$ are provided with respect to each antenna element $1_i$. A reception signal received by the antenna element $1_i$ is weighted by the corresponding weighting circuit 5-5 via the RFF/E 5-1$_i$ and the transmitter-receiver 5-2$_i$. The weighting circuit 5-5 corresponding to each antenna element $1_i$ is controlled by the weighting control circuit 5-4, so as to maximize a signal-to-interference-plus-noise ratio (SINR) of an output signal of the combining circuit 5-6. The output signal of the combining circuit 5-6 is obtained by combining the weighted reception signals obtained via the weighting circuits 5-5.

Figure 12:
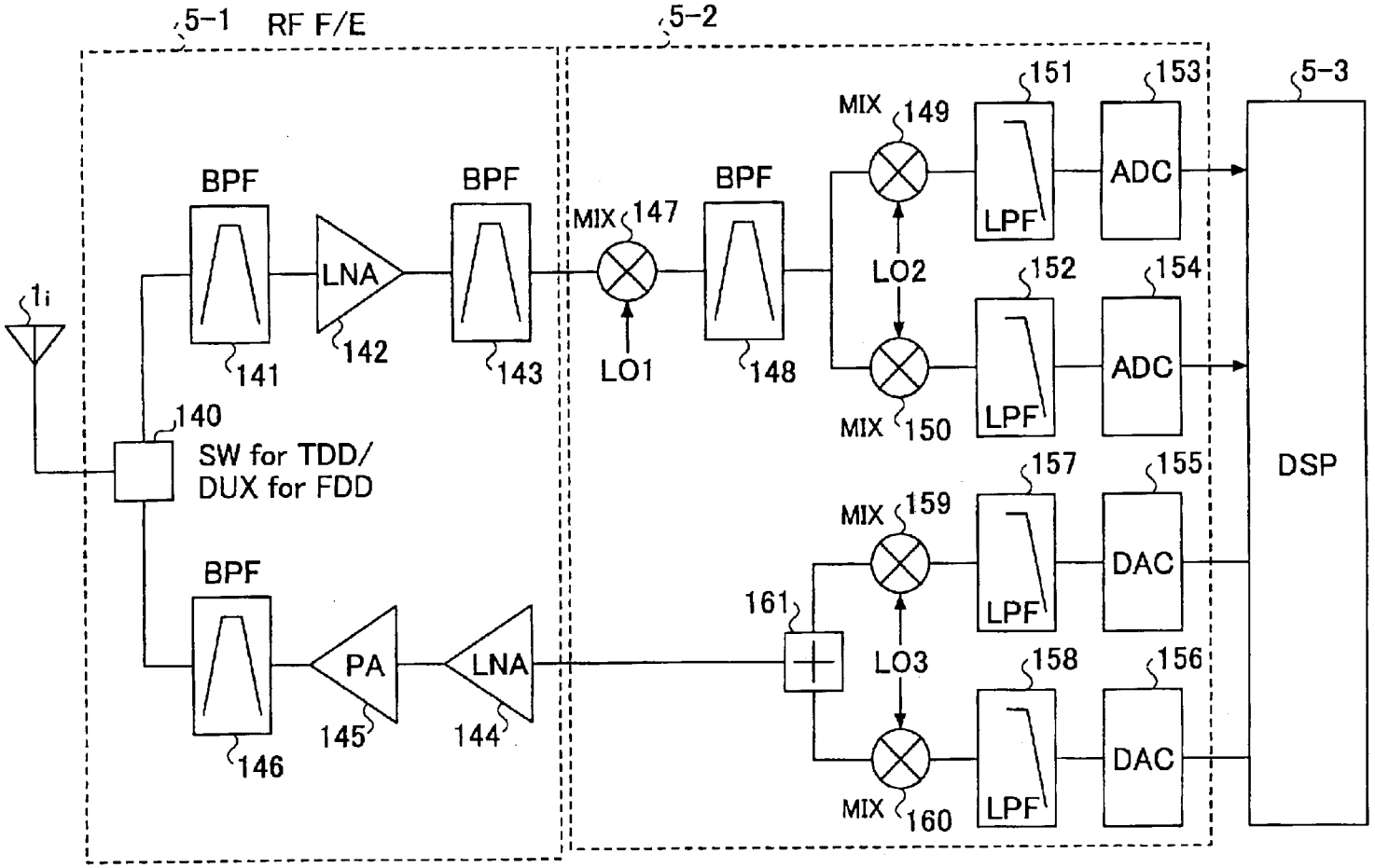
FIG. 12 is a diagram for explaining a transmitter-receiver circuit corresponding to one antenna element.

FIG. 12 is a diagram for explaining a transmitter-receiver circuit corresponding to one antenna element $1_i$. The transmitter-receiver circuit shown in FIG. 12 includes one RFF/E 5-1$_i$ and one transmitter-receiver (T/R) 5-2$_i$ respectively corresponding to one antenna element $1_i$ shown in FIG. 6 or 7, and the digital signal processing circuit 5-3 which is formed by a digital signal processor (DSP).

The RFF/E 5-1$_i$ includes a transmitter-receiver shared unit 140, bandpass filters (BPFs) 141, 143 and 146, low-noise amplifiers (LNA) 142 and 144, and a power amplifier (PA) 145. The transmitter-receiver share unit 140 includes a switch and a filter to enable sharing of the antenna element $1_i$ for the transmission and the reception.

The transmitter-receiver 5-2$_i$ includes a mixer 147, a bandpass filter (BPF) 148, demodulators 149 and 150, lowpass filters (LPFs) 151 and 152, analog-to-digital converters (ADCs) 153 and 154, digital-to-analog converters (DACs) 155 and 156, lowpass filters (LPFs) 157 and 158, modulators 159 and 160, a combining (+) circuit 161, and local oscillators LO1 through LO3.

The RFF/E 5-1$_1$ eliminates by the BPF 141 an unwanted band component of the reception signal received by the antenna element 1$_i$ and obtained via the transmitter-receiver shared unit 140. An output of the BPF 141 is amplified by the LNA 142 and input to the transmitter-receiver 5-2$_i$ via the BPF 143. In addition, the RFF/E 5-1$_i$ amplifies by the LNA 144 the transmission signal received from the transmitter-receiver 5-2$_i$. An output of the LNA 144 is amplified by the PA 145 to a desired transmission power. An output of the PA 145 is input to the BPF 146 which eliminates an unwanted band component, and an output of the BPF 146 is input to the antenna element 1$_i$ via the transmitter-receiver shared unit 140 and is transmitted from the antenna element 1$_i$.

In the transmitter-receiver 5-2$_i$, the mixer 147 mixes the output of the BPF 143 and a local oscillation signal from the local oscillator LO1 to output an intermediate frequency (IF) signal. The BPF 148 eliminates an unwanted band component of the IF signal received from the mixer 147. The demodulators 149 and 150 have structures similar to the mixer 147. Hence, an output of the BPF 148 is mixed with 90-degree phase local oscillation signals from the local oscillator LO2 in the respective demodulators 149 and 150. Outputs of the demodulators 149 and 150 are input to the corresponding LPFs 151 and 152 wherein unwanted high-frequency components are eliminated. Outputs of the LPFs 151 and 152 are converted into digital signals by the corresponding ADCs 153 and 154. The digital signals output from the ADCs 153 and 154 are finally input to the digital signal processing circuit 5-3, so as to form a reception path.

On the other hand, digital signals output from the digital signal processing circuit 5-3 are converted into analog signals in the corresponding DACs 155 and 156, and input to the corresponding LPFs 157 and 158 wherein unwanted high-frequency components are eliminated. Outputs of the LPFs 157 and 158 are input to the corresponding modulators 159 and 160 and modulated by 90-degreee phase local oscillation signals from the local oscillator LO3. Outputs of the modulators 159 and 160 are combined in the combining circuit 161 and finally input to the RFF/E 5-1$_i$, so as to form a transmission path.

However, when the RFF/E 5-1$_i$ and the transmitter-receiver 5-2$_i$ are provided with respect to each antenna element 1$_i$, the circuit scale of the transmitter-receiver circuit becomes large as the number of antenna elements increases. In addition, the size of the antenna unit increases and the power consumption of the antenna unit increases as the number of antenna elements increases.

Accordingly, it is possible to reduce the size and power consumption of the antenna unit by employing, in place of the array antenna which controls the directivity in the baseband digital signal processing circuit, an antenna structure which controls the directivity by arranging parasitic antenna elements in a periphery of the feeding antenna elements and controlling reactance components of the parasitic antenna elements.

Figure 13:
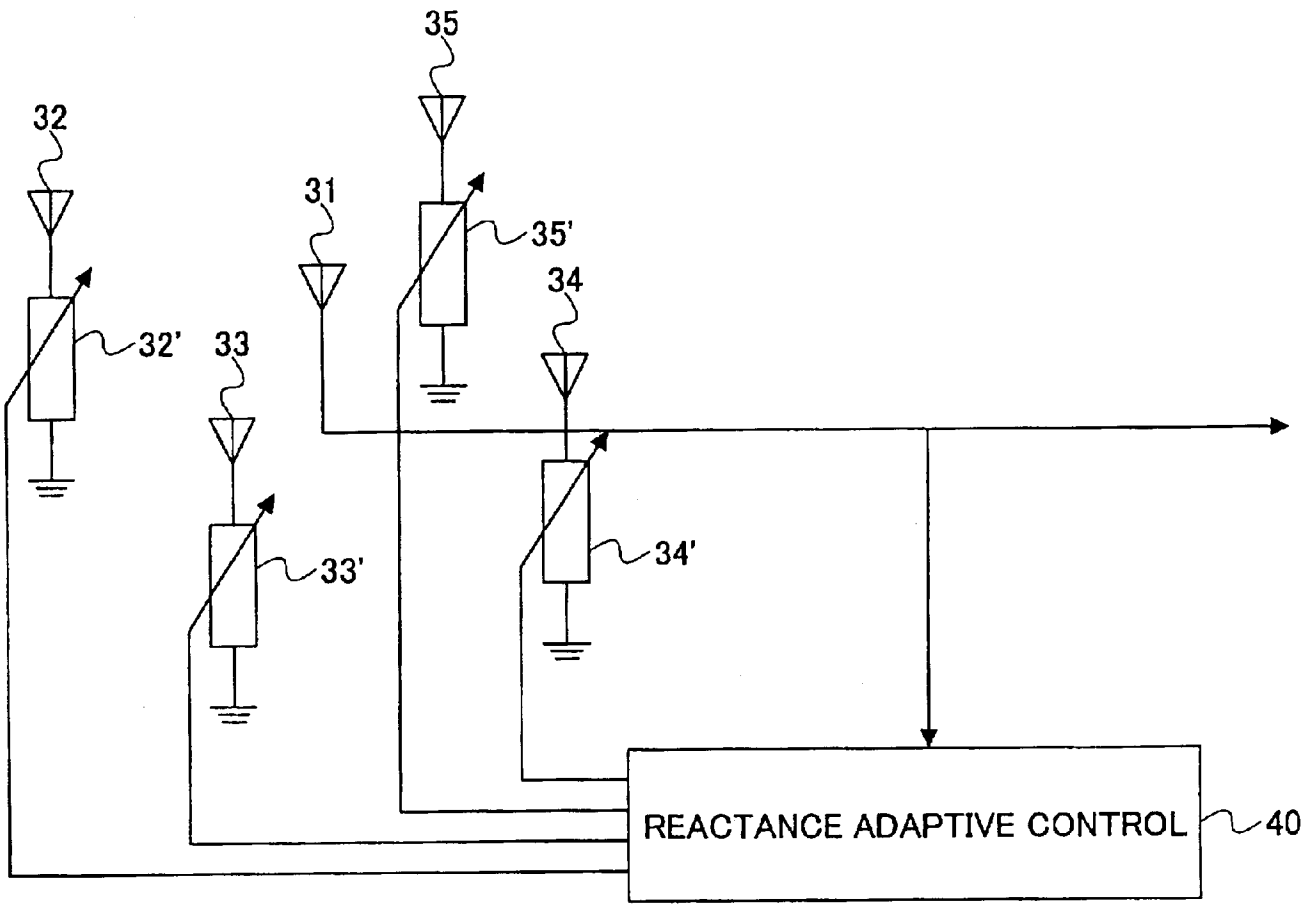
FIG. 13 is a diagram showing a basic structure of an adaptive antenna unit having parasitic antenna elements arranged in a periphery of a feeding antenna element.

FIG. 13 is a diagram showing a basic structure of an adaptive antenna unit having parasitic antenna elements arranged in a periphery of a feeding antenna element, so as to control the directivity. The adaptive antenna unit shown in FIG. 13 includes a feeding antenna element 31, parasitic antenna elements 32 through 35, variable reactance elements 32' through 35', and a reactance adaptive controller 40. The parasitic antenna elements 32 through 35 are arranged in a periphery of the feeding antenna element 31 which receives and transmits signals by being supplied with power. The parasitic antenna elements 32 through 35 are arranged at a distance which is generally $\lambda/4$ from the feeding antenna element 31, where $\lambda$ denotes the wavelength, so as to achieve mutual coupling (or interconnection) with respect to the feeding antenna element 31. In addition, the parasitic antenna elements 32 through 35 are terminated by corresponding variable reactance elements 32' through 35'. Reactance components of the variable reactance elements 32' through 35' are controlled by the reactance adaptive controller 40, so as to maximize a signal-to-interference ratio (SIR) of the reception signal.

A structure in which a plurality of parasitic antenna elements each terminated by a variable reactance element are arranged with respect to a single feeding antenna element is sometimes referred to as an electronically steerable passive array radiator (ESPAR). For example, the ESPAR itself is discussed in R. J. Dinger and W. D. Meyers, "A compact HF antenna array using reactively-terminated parasitic elements for pattern control", Naval Research Laboratory Memorandum Report 4797, May 1992, R. J. Dinger, "Reactively steered adaptive array using microstrip patch at 4 GHz", IEEE Trans. Antennas & Propag., vol.AP-32, No. 8, pp. 848–856, August 1984, and Japanese Laid-Open Patent Application No. 2002-16432.

The antenna unit having the ESPAR structure only requires one RFF/E and one transmitter-receiver with respect to the reception signal received by the single feeding antenna element 31. In addition, by controlling the reactance components of the variable reactance elements 32' through 35' which terminate the corresponding parasitic antenna elements 32 through 35, some of the parasitic antenna elements 32 through 35 may function as a reflector and the others may function as a director, so as to form the desired directivity and suppress the interference. As a result, both the size and power consumption of the antenna unit can be reduced by the ESPAR structure, thereby making this ESPAR structure suited for application to the mobile terminal.

The variable reactance elements 32' through 35' of the parasitic antenna elements 32 through 35 may use micro electro mechanical system (MEMS) variable capacitors provided within the RRF/E, so as to form the directivity by controlling the MEMS variable capacitors.

Figure 14:
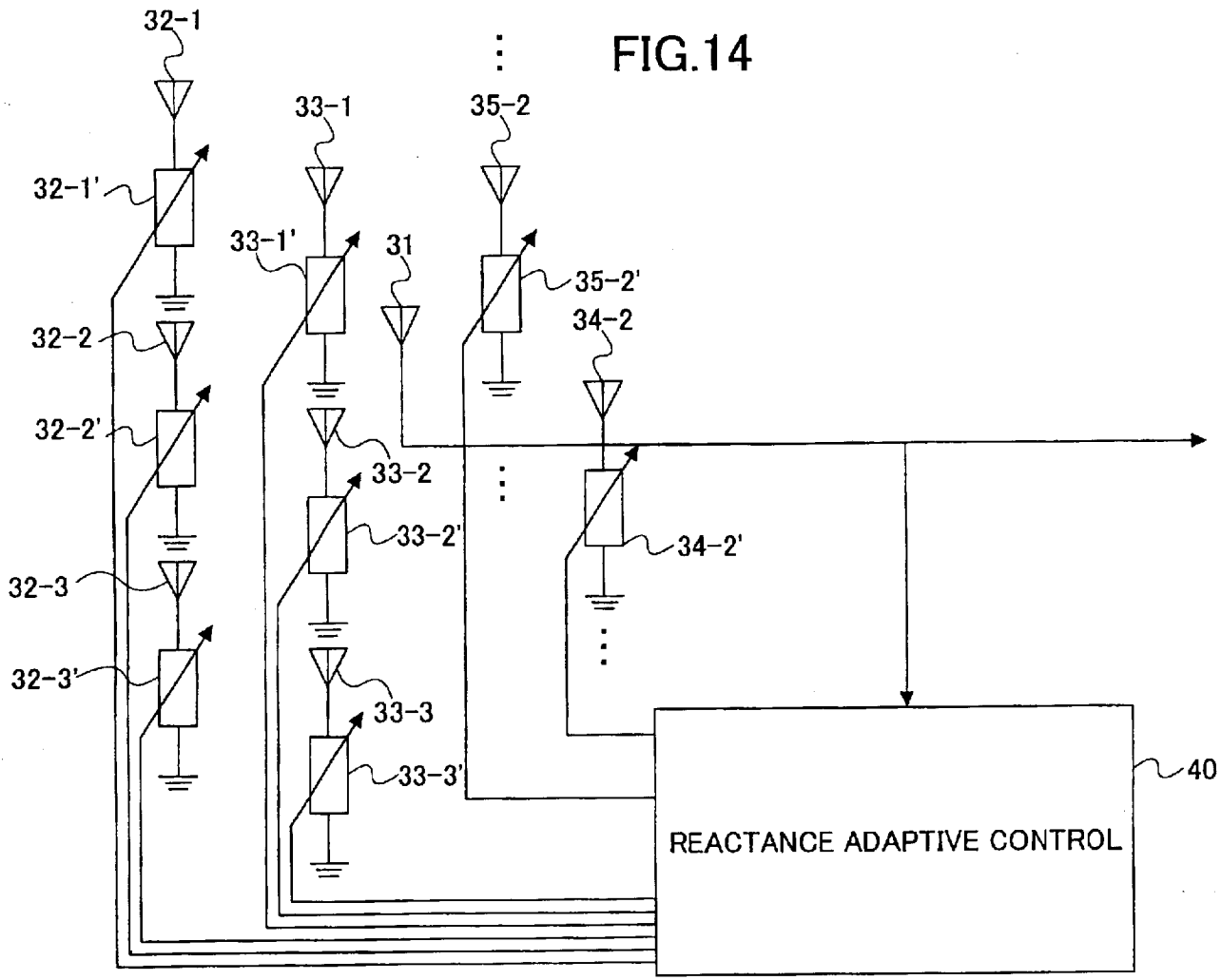
FIG. 14 is a diagram showing a basic structure of an adaptive antenna unit having antenna elements stacked in a vertical direction.

FIG. 14 is a diagram showing a basic structure of an adaptive antenna unit having antenna elements stacked in a vertical direction. In FIG. 14, those parts which are the same as those corresponding parts in FIG. 13 are designated by the same reference numerals, and a description thereof will be omitted.

When forming the directivity in a three-dimensional space, the horizontally arranged parasitic antenna elements may be stacked in a plurality of stages in the vertical direction. FIG. 14 shows a case where parasitic antenna elements 32-1, 32-2 and 32-3 are stacked in three stages in the vertical direction. The other parasitic antenna elements 33-1 through 33-3, 34-1 through 34-3, and 35-1 through 35-3 are stacked similarly in the vertical direction. Alternatively, it is possible to arrange the feeding antenna elements in the vertical direction, so as to control the beam directivity by a phase-shift control as in the case of a phased array antenna.

Variable reactance elements 32-1', 32-2' and 32-3' are respectively connected to the parasitic antenna elements 32-1, 32-2 and 32-3, and the reactance components of the variable reactance elements 32-1', 32-2' and 32-3' are controlled. Similarly, variable reactance elements 33-1' through 33-3', 34-1' through 34-3', and 35-1' through 35-3' are respectively connected to the parasitic antenna elements 33-1 through 33-3, 34-1 through 34-3, and 35-1 through 35-3, and reactance components of the variable reactance elements 33-1' through 33-3', 34-1' through 34-3', and 35-1' through 35-3' are controlled. As a result, it is possible to form the directivity in a horizontal direction and in an arbitrary direction inclined from the horizontal direction.

Compared to the structure shown in FIG. 13 which controls the directivity in the two-dimensional plane, the structure shown in FIG. 14 which controls the directivity in the three-dimensional space requires a large number of parasitic antenna elements corresponding to the number of stages (three in this particular case) in the stacked structure. However, only a single feeding antenna element 31 is required in the structure shown in FIG. 14. Hence, the structure shown in FIG. 14 simply needs to control the reactance components of the variable reactance elements terminating the parasitic antenna elements, and a transmitter-receiver section required in this case has a small circuit scale and a small power consumption compared to that shown in FIG. 10 described above.

Figure 15:
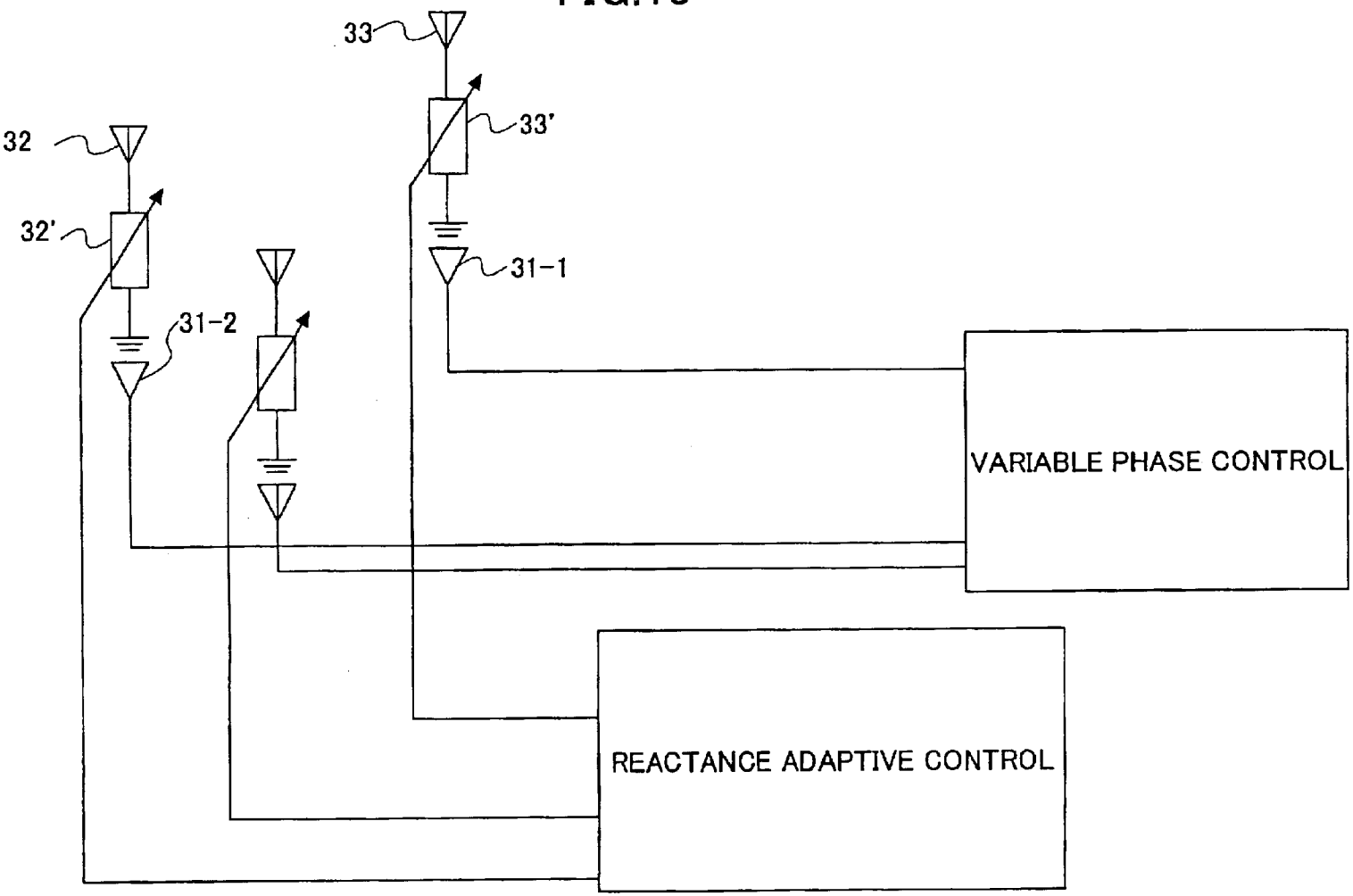
FIG. 15 is a diagram showing a basic structure of an adaptive antenna unit having the same number of feeding antenna elements parasitic antenna elements.

FIG. 15 is a diagram showing a basic structure of an adaptive antenna unit having the same number of feeding antenna elements parasitic antenna elements. In FIG. 15, those parts which are the same as those corresponding parts in FIG. 13 are designated by the same reference numerals, and a description thereof will be omitted.

FIG. 15 shows a case where a plurality of feeding antenna elements 31-1 and 31-2, and the same number of parasitic antenna elements 32 and 33, are provided. The directivity in the vertical direction is controlled by the phase control with respect to the feeding antenna elements 31-1 and 31-2, similarly to the phase control described above with reference to FIG. 1, and the directivity in the horizontal direction is controlled by controlling the reactance components of variable reactance elements 32' and 33' respectively terminating the corresponding parasitic antenna elements 32 and 33. Alternatively, it is of course possible to control the directivity in the horizontal direction by the phase control with respect to the feeding antenna elements 31-1 and 31-2, and to control the directivity in the vertical direction by controlling the reactance components of variable reactance elements 32' and 33' respectively terminating the corresponding parasitic antenna elements 32 and 33.

According to the structure shown in FIG. 15, it is difficult to greatly shift the directivity in the vertical direction from the horizontal direction, such as directing the directivity towards a perpendicular direction. However, it is possible to form a directivity which is inclined upwards or downwards by approximately 20 degrees from the horizontal direction. Hence, when the user communicates in a normal state where the user holding the mobile terminal is standing or walking, it is possible to easily form the directivity in the direction of the base station.

In the case of telephone sets such as the personal digital cellular phone (PDC) and the personal handy phone system (PHS), the transmitting and receiving frequencies are the same and the antenna element can be shared for the transmission and the reception. However, in the case of telephone sets employing the wide band code division multiple access (W-CDMA), the transmitting and receiving frequencies are different because the frequency division duplex (FDD) is used. More particularly, in a band in a vicinity of a center frequency of 2 GHz, frequencies used for the transmission and the reception differ by approximate 200 MHz.

For this reason, an adaptive antenna unit to be used for the W-CDMA must be designed for the wide band or, two different sets of antenna elements must be provided for the transmission and the reception. Since the band tends to become narrow in the case of the adaptive antenna unit using the variable reactance elements, it is desirable to provide two different sets of antenna elements for the transmission and the reception.

Figure 16:
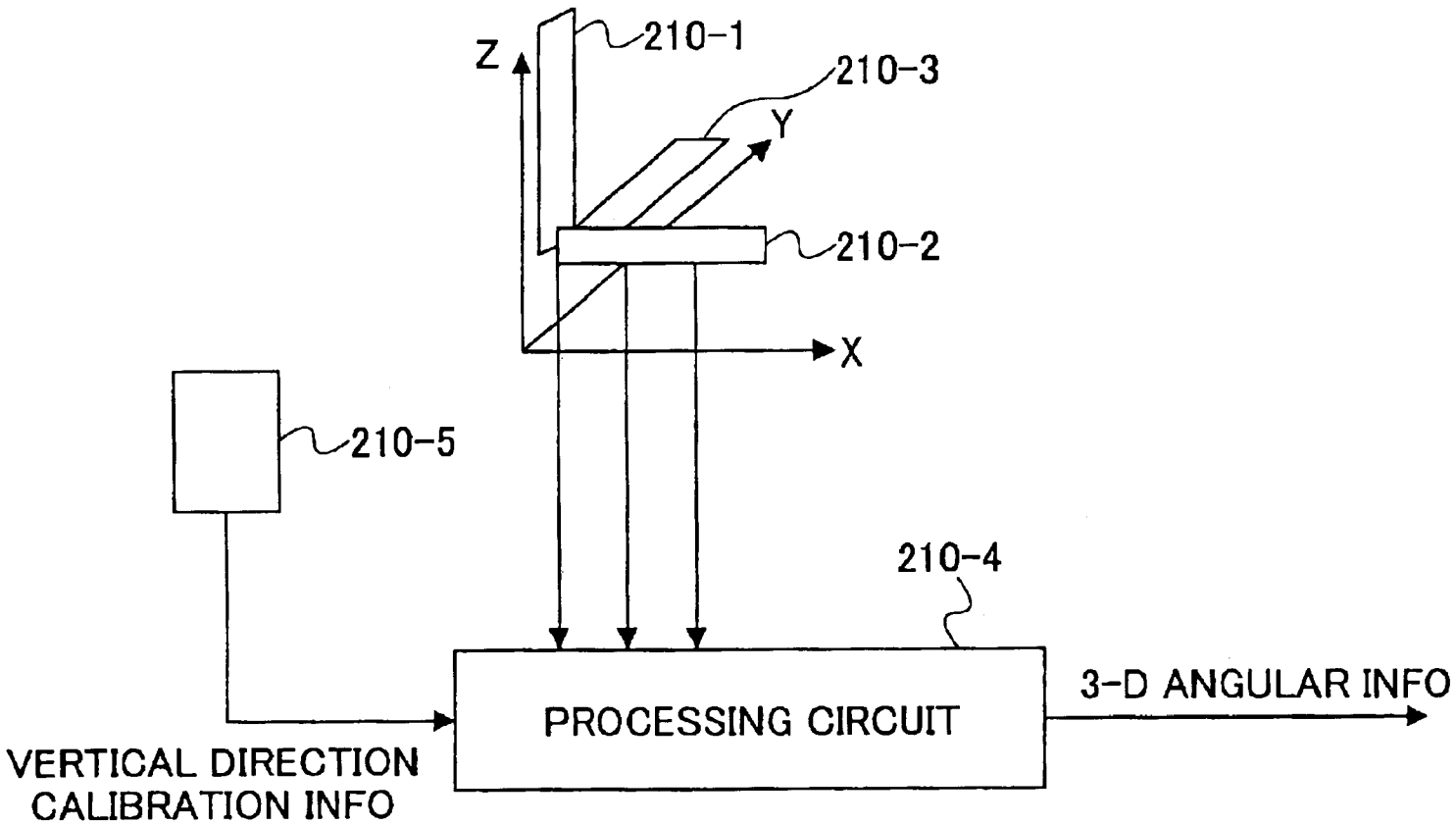
FIG. 16 is a diagram showing a structure of an azimuth sensor using three angular velocity detection type gyro sensors.

FIG. 16 is a diagram showing a structure of the azimuth sensor using three angular velocity detection type gyro sensors. A three-dimensional rotary motion velocity is detected by a first gyro sensor 210-1 which detects rotation about an x-axis, a second gyro sensor 210-2 which detects rotation about a y-axis, and a third gyro sensor 210-3 which detects rotation about a z-axis. Output detection signals of the first through third gyro sensors 210-1 through 210-3 are integrated in a signal processing circuit 210-4, so as to detect the three-dimensional direction of the rotation of inclination.

Furthermore, an electrostatic capacitance type acceleration sensor 210-5 detects the inclination of the mobile terminal from the gravitational direction. Hence, the signal processing circuit 210-4 carry out a calibration with respect to the three-dimensional direction of the rotation or inclination detected by the first through third gyro sensors 210-1 through 210-3, so as to improve the accuracy of the three-dimensional direction of the rotation or inclination.

Figure 17:
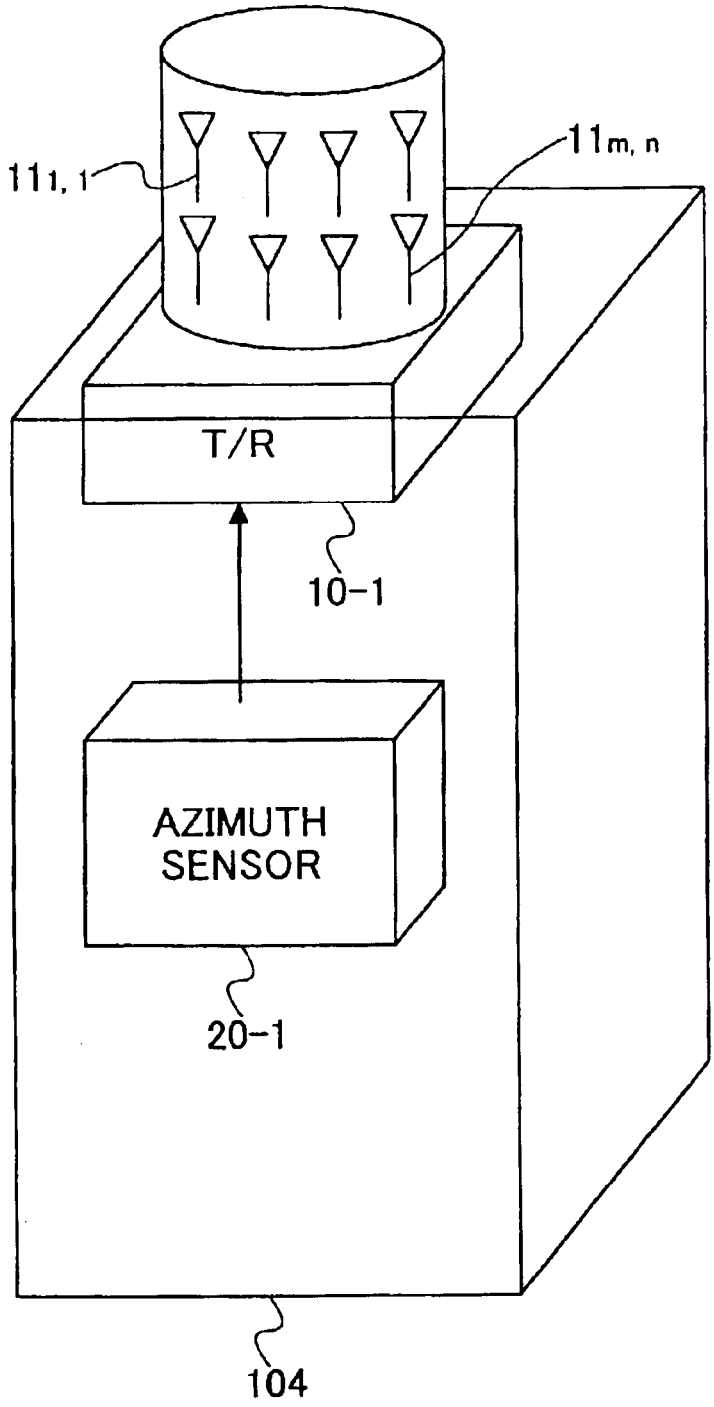
FIG. 17 is a diagram showing a basic structure of a fifth embodiment of the adaptive antenna unit according to the present invention.

FIG. 17 is a diagram showing a basic structure of a fifth embodiment of the adaptive antenna unit according to the present invention. In FIG. 17, those parts which are the same as those corresponding parts in FIG. 9 are designated by the same reference numerals, and a description thereof will be omitted.

A mobile terminal 104 shown in FIG. 17 includes a three-dimensional azimuth sensor 20-1, and a transmitter-receiver section 10-1. The three-dimensional azimuth sensor 20-1 has the structure shown in FIG. 16 including gyro sensors and an electrostatic capacitance type acceleration sensor, and detects a three-dimensional direction. On the other hand, the transmitter-receiver section 10-1 includes a three-dimensional directivity controller for controlling the three-dimensional directivity in the manner described above. By combining the three-dimensional azimuth sensor 20-1 and the three-dimensional directivity controller, it becomes possible to control the directivity so that the directivity is always in the direction of the base station in which direction the sensitivity is a maximum, even in the case of a mobile terminal which changes position three-dimensionally as in the case of a mobile telephone set.

According to the conventional adaptive array antenna unit, it is necessary to carry out a process of constantly monitoring the reception sensitivity and searching for a direction of the directivity which results in a maximum sensitivity. However, such a process puts a large load on a processor, and a power consumption for this process is also large. Hence, once the direction of the directivity with the maximum sensitivity is searched, the direction with the maximum sensitivity may be corrected using the three-dimensional direction information of the rotation or inclination detected by the azimuth sensor.

One of the following methods (m1) and (m2) may be used to correct the direction with the maximum sensitivity using the rotation or inclination information detected by the azimuth sensor.

(m1) When a motion is detected by the azimuth sensor, a control is carried out again to form a directivity which can obtain the maximum sensitivity, by the phase adaptive control of the feeding antenna element or the reactance adaptive control of the parasitic antenna element.

(m2) Depending to the rotation or inclination information detected by the azimuth sensor, the direction of the directivity is corrected, by the phase adaptive control of the feeding antenna element or the reactance adaptive control of the parasitic antenna element.

According to the method (m2), when the azimuth sensor detects that the mobile terminal turned 10 degrees clockwise within the horizontal plane, the directivity forming direction is corrected by being turned 10 degrees counterclockwise. As a result, it is always possible to maintain the directivity in the direction in which the sensitivity is a maximum.

When a long time elapses, however, the direction with the maximum sensitivity changes due to the change in the position of the mobile terminal, and an accumulated error of the azimuth sensor increases. Hence, it is desirable for the adaptive antenna unit to periodically search for the direction with which the maximum sensitivity is obtained, and reset the directivity forming direction.

Figure 18:
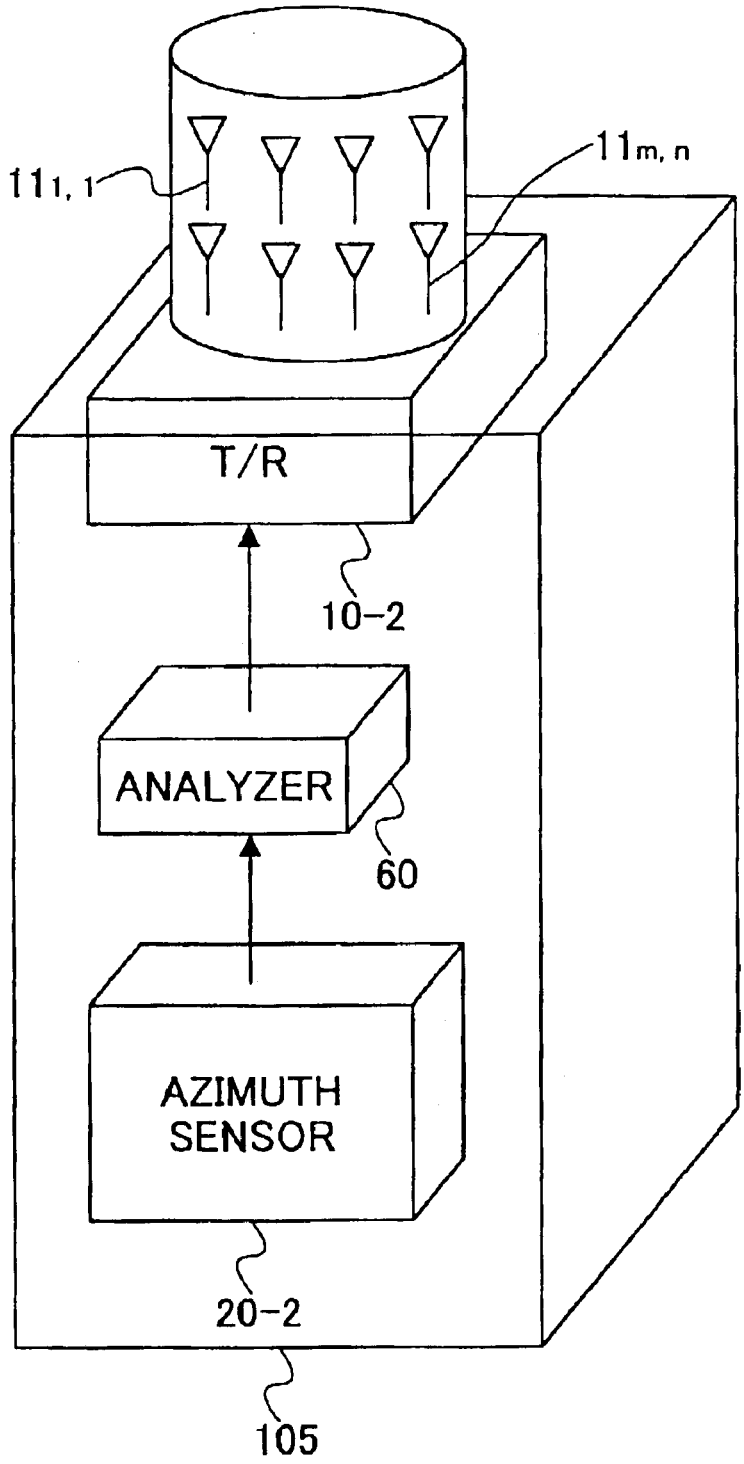
FIG. 18 is a diagram showing a basic structure of a sixth embodiment of the adaptive antenna unit according to the present invention.

Next, a description will be given of a sixth embodiment of the adaptive antenna unit according to the present invention which controls the directivity by using the position information. FIG. 18 is a diagram showing a basic structure of this sixth embodiment of the adaptive antenna unit. In FIG. 18, those parts which are the same as those corresponding parts in FIG. 9 are designated by the same reference numerals, and a description thereof will be omitted.

A mobile terminal 105 shown in FIG. 18 includes a three-dimensional azimuth sensor 20-2, an analyzer 60, and a transmitter-receiver section 10-2. The three-dimensional azimuth sensor 20-2 includes a GPS and a terrestrial magnetic sensor. The GPS measures the position of the mobile terminal 105 using satellites, and outputs the position information related to the present position of the mobile terminal 105. The analyzer 60 detects the position of a nearby base station, based on the position information output from the GPS of the three-dimensional sensor 20-2.

The position of the base station may be obtained by a first method which makes reference to the map information stored within the mobile terminal 105 or, a second method which transmits the present position information of the mobile terminal 105 to the base station, searches for a certain base station closest to the present position of the mobile terminal 105 by the base station which receives the present position information and receives the information of the certain base station by the mobile terminal 105.

A large memory capacity is required to store the map information within the mobile terminal 105 as in the case of the first method. For this reason, the second method is normally used. In the case of the second method, the control by the array antenna is unnecessary because the position information of the certain base station is transmitted and received at a low bit rate. The azimuth of the certain base station when viewed from the mobile terminal 105 is recognized by the analyzer 60 based on the position information of the mobile terminal 105 and the position information of the certain base station. Hence, based on the azimuth of the certain base station recognized by the analyzer 60, the transmitter-receiver section 10-2 carries out a control so as to form the directivity in the direction of the recognized azimuth.

In city areas, it is not always the case that the direction towards the base station has the maximum sensitivity, due to the effects of diffraction and reflection based by buildings and the like. Accordingly, the transmitter-receiver section 10-2 further controls the directivity in the direction in which the maximum sensitivity is obtained by the method described above in conjunction with FIG. 10 or FIG. 8. But in this case, because the azimuth of the base station is recognized in advance, it becomes possible to predict the direction of an optimum directivity. Hence, the process of controlling the directivity can be simplified and the power consumption can be reduced by forming the directivity based on this prediction.

In each of the embodiments described above, the antenna directivity may be selected from a plurality of mutually different directivity patterns depending on a wave propagation environment.

In addition, an initial antenna directivity at a start of a communication may be set to an antenna directivity which is formed last in a standby state, when starting the communication from the standby state.

Moreover, the control of the antenna directivity based on the at least one of rotation, inclination and position of the mobile terminal detected by the azimuth sensor, and the control of the antenna directivity to improve the reception characteristic based on the reception signals received from the plurality of antenna elements may be carried out alternately.

The adaptive antenna unit may also include a means for controlling the antenna directivity based on the at least one of rotation, inclination and position of the mobile terminal detected by the azimuth sensor with respect to a quick change in the antenna directivity, and controlling the antenna directivity to improve the reception characteristic based on the reception signals received from the plurality of antenna elements with respect to a gradual change in the antenna directivity.

Of course, the mobile terminal according to the present invention is not limited to mobile telephone sets and portable telephone sets, and the present invention is similarly applicable to other communication equipments having a function of making wireless communication, such as a portable personal computer and a data communication apparatus.

Therefore, according to the present invention, it is possible to control the antenna directivity depending on the motion in the azimuth or inclination of the mobile terminal, by correcting the directivity in the direction of the base station based on the information detected by the azimuth sensor, such as the rotation, inclination and position of the mobile terminal. In addition, it is possible to maintain a large gain in the direction of the base station, and to efficiently improve the sensitivity, so that the power consumption can be reduced.

Furthermore, by the arrangement of the antenna elements forming the directivity in the three-dimensional direction and the control thereof, it is possible to appropriately form the directivity towards the base station from the mobile terminal, even when the mobile terminal is inclined or the mobile terminal is located under the base station. Moreover, in a case where the mobile terminal is set on a desk or the like, a strong radio wave will normally not reach the mobile terminal from the direction of the floor, and thus, it is possible to efficiently improve the reception sensitivity by controlling the directivity in an upward direction from the desk surface so that the reception sensitivity is higher in the direction from which the strong radio wave arrives. In addition, because the directivity can also be appropriately formed only in the direction of the base station when making the transmission, it is possible to transmit the transmitting signals efficiently at a low power consumption.

When the parasitic antenna elements each terminated by the variable reactance element are used, it is possible to control the antenna directivity by controlling the reactance component of the variable reactance element of each of the parasitic antenna elements. As a result, it is possible to realize an adaptive antenna unit which has a small size and a low power consumption, and is easily accommodated within a mobile terminal.

Further, the present invention is not limited to these embodiments, but various variations and modifications may be made without departing from the scope of the present invention.

What is claimed is:

1. An adaptive antenna unit which is adapted to a mobile terminal for making mobile communication and adaptively forms an antenna directivity in a direction of a base station which exchanges signals with the mobile terminal, comprising:

an azimuth sensor to detect at least one of rotation, inclination and present position of the mobile terminal;

a transmitter-receiver section to adaptively control the antenna directivity in a direction in which a reception characteristic improves based on reception signals received from a plurality of antenna elements forming the antenna directivity, said plurality of antenna elements including parasitic antenna elements each terminated by a variable reactance element;

a section to correct the antenna directivity in the direction of the base station, based on the at least one of rotation, inclination and present position of the mobile terminal detected by the azimuth sensor; and a section to control the antenna directivity by varying a reactance component of the variable reactance element of each of the parasitic antenna elements.

2. The adaptive antenna unit as claimed in claim 1, wherein:

the plurality of antenna elements are arranged to form the antenna directivity in a three-dimensional direction; and further comprising:

means for controlling the antenna directivity in the three dimensional direction with respect to the plurality of antenna elements.

3. The adaptive antenna unit as claimed in claim 2, wherein the direction in which the antenna directivity is controlled based on the at least one of rotation, inclination and position of the mobile terminal detected by the azimuth sensor, and the direction in which the antenna directivity is controlled to improve the reception characteristic based on the reception signals received from the plurality of antenna elements, are of mutually different dimensions.

4. The adaptive antenna unit as claimed in claim 3, wherein the direction in which the antenna directivity is controlled based on the at least one of rotation, inclination and position of the mobile terminal detected by the azimuth sensor is perpendicular to a plane in which each of the plurality of antenna elements is arranged, and the direction in which the antenna directivity is controlled to improve the reception characteristic based on the reception signals received from the plurality of antenna elements is within the plane in which each of the plurality of antenna elements is arranged.

5. The adaptive antenna unit as claimed in claim 1, wherein:

the azimuth sensor includes a sensor to detect a gravitational direction; and further comprising:

means for correcting a direction of rotation or inclination of the mobile terminal based on the gravitational direction detected by the sensor.

6. The adaptive antenna unit as claimed in claim 1, wherein:

the azimuth sensor includes a global positioning system (GPS) to detect present position information related to a present position of the mobile terminal; and further comprising:

means for detecting a direction of a closest base station, based on the present position information detected by the GPS and map information, said map information being selected from a group consisting of map information prestored within the mobile terminal and map information notified from the base station.

7. The adaptive antenna unit as claimed in claim 1, further comprising:

a transmitter-receiver radio frequency front end including a micro electro mechanical system (MEMS) variable capacitor forming the variable reactance element of each of the parasitic antenna elements.

8. The adaptive antenna unit as claimed in claim 1, wherein the antenna directivity is selected from a plurality of mutually different directivity patterns depending on a wave propagation environment.

9. The adaptive antenna unit as claimed in claim 1, wherein an initial antenna directivity at a start of a communication is set to an antenna directivity which is formed last in a standby state, when starting the communication from the standby state.

10. The adaptive antenna unit as claimed in claim 1, wherein the control of the antenna directivity based on the at least one of rotation, inclination and position of the mobile terminal detected by the azimuth sensor and the control of the antenna directivity to improve the reception characteristic based on the reception signals received from the plurality of antenna elements are carried out alternately.

11. The adaptive antenna unit as claimed in claim 1, further comprising:

means for controlling the antenna directivity based on the at least one of rotation, inclination and position of the mobile terminal detected by the azimuth sensor with respect to a quick change in the antenna directivity, and controlling the antenna directivity to improve the reception characteristic based on the reception signals received from the plurality of antenna elements with respect to a gradual change in the antenna directivity.

12. The adaptive antenna unit as claimed in claim 1, wherein the parasitic antenna elements are stacked in a plurality of stages.

13. The adaptive antenna unit as claimed in claim 1, wherein the plurality of antenna elements are arranged at a pitch which is less than or equal to one wavelength.

14. A mobile terminal for making mobile communication with a base station by exchanging signals, comprising:

a plurality of antenna elements to adaptively form an antenna directivity in a direction of the base station, and including parasitic antenna elements each terminated by a variable reactance element;

an azimuth sensor to detect at least one of rotation, inclination and present position of the mobile terminal;

a transmitter-receiver section to control the antenna directivity in a direction in which a reception characteristic improves based on reception signals received from the plurality of antenna elements;

a section to correct the antenna directivity in the direction of the base station, based on the at least one of rotation, inclination and present position of the mobile terminal detected by the azimuth sensor; and a section to control the antenna directivity by varying a reactance component of the variable reactance element of each of the parasitic antenna elements.

15. The mobile terminal as claimed in claim 14, wherein:

the plurality of antenna elements are arranged to form the antenna directivity in a three-dimensional direction; and further comprising:

means for controlling the antenna directivity in the three-dimensional direction with respect to the plurality of antenna elements.

16. The mobile terminal as claimed in claim 14, wherein:

the azimuth sensor includes a sensor to detect a gravitational direction; and further comprising:

means for correcting a direction of rotation or inclination of the mobile terminal based on the gravitational direction detected by the sensor.

17. The mobile terminal as claimed in claim 14, wherein:

the azimuth sensor includes a global positioning system (GPS) to detect present position information related to a present position of the mobile terminal; and further comprising:

means for detecting a direction of a closest base station, based on the present position information detected by the GPS and map information, said map information being selected from a group consisting of map information prestored within the mobile terminal and map information notified from the base station.

* * * * *